US006119955A

United States Patent [19]

Starr

[11] Patent Number: 6,119,955

[45] Date of Patent: Sep. 19, 2000

[54] METHOD AND APPARATUS FOR PRODUCING LIQUID PROJECTILES

[75] Inventor: Joseph W. Starr, Burbank, Calif.

[73] Assignee: Technifex, Inc., Valencia, Calif.

[21] Appl. No.: 09/078,105

[22] Filed: May 13, 1998

[51] Int. Cl.[7] ..... B05B 17/04

[52] U.S. Cl. ..... 239/11; 239/17; 239/69; 239/99; 239/280.5

[58] Field of Search ..... 239/1, 11, 12, 239/16–23, 99, 101, 69, 273, 280.5, 285, 587.1

[56] References Cited

U.S. PATENT DOCUMENTS

| | | | |
|---|---|---|---|
| 691,419 | 1/1902 | Vandervoort | 239/99 |
| 3,047,240 | 7/1962 | Lent | 239/99 |
| 3,520,477 | 7/1970 | Cooley | 239/101 |
| 3,521,820 | 7/1970 | Cooley | 239/101 |
| 3,729,137 | 4/1973 | Cobb et al. | 239/101 |
| 3,748,953 | 7/1973 | Godgfrey | 239/101 |
| 4,231,283 | 11/1980 | Malburg | 239/101 |
| 4,594,697 | 6/1986 | Pascouet | 367/146 |
| 4,795,092 | 1/1989 | Fuller | 239/12 |
| 4,852,801 | 8/1989 | Fuller et al. | 239/12 |
| 4,955,540 | 9/1990 | Fuller et al. | 239/20 |
| 4,978,066 | 12/1990 | Fuller et al. | 239/12 |
| 5,078,320 | 1/1992 | Fuller et al. | 239/20 |
| 5,115,973 | 5/1992 | Fuller et al. | 239/20 |
| 5,419,458 | 5/1995 | Mayer | 222/79 |
| 5,553,779 | 9/1996 | Fuller et al. | 239/17 |
| 5,802,750 | 9/1998 | Fulmer | 239/23 |

*Primary Examiner*—Andres Kashnikow
*Assistant Examiner*—J. Bocanegra
*Attorney, Agent, or Firm*—Holme, Roberts & Owens, LLP

[57] ABSTRACT

A liquid projectile apparatus is provided that is particularly apt for use in water displays in which liquid projectiles of a selectable size and shape are provided along variable trajectories at timed intervals or on demand. In one embodiment, the apparatus includes a liquid source, a housing assembly within which a mechanical discharge assembly is positioned, and a discharge positioning assembly. The discharge positioning assembly is provided for selectively positioning the housing assembly in various discharge positions to produce liquid projectiles with desired trajectories (e.g., discharge angles and directions). The liquid source supplies a discrete volume of liquid, with which a liquid projectile is formed, to the housing assembly. The mechanical discharge assembly is then operable to project the discrete volume of liquid from the housing assembly along a selected trajectory.

29 Claims, 4 Drawing Sheets

METHOD AND APPARATUS FOR PRODUCING LIQUID PROJECTILES

FIELD OF THE INVENTION

The present invention relates in general to the production of liquid displays, i.e., water displays, for the entertainment of viewers of the displays. In particular, the present invention relates to a method and apparatus for producing liquid projectiles as part of a water display. The present invention is particularly useful in connection with water displays in which it is desirable to provide liquid projectiles at various locations, or on variable trajectories, at timed intervals or on demand, i.e., to provide controllable release of the liquid projectile.

BACKGROUND OF THE INVENTION

Liquid display devices are utilized in a wide variety of visual entertainment applications including fountains, aquatic shows featuring trained marine animals, and amusement or theme park rides involving water. Typically, liquid (e.g., water) is discharged from a water display device in a continuous or intermittent spray or column to create the illusion of a sea spray, to produce a water fall, or to provide various other aesthetic effects. One type of water display device, for example, employs a continuous flow of pressurized water to produce a well-defined column of water. By periodically diverting the continuous flow of water, the water display device can periodically discharge discrete columns of water. Combining several of these water display devices in series creates the illusion that each device first catches a discharged column of water and then passes that same column of water to the next device. This type of water display device generally is limited to fountain applications and the like which provide a large water source for continuous recirculation. Additionally, this type of device involves continuous operation which may be undesirable for some applications and use carefully established, fixed trajectories (e.g., a trajectory to pass the water to the next such device in the series).

Other types of water display devices discharge a volume of water vertically for aesthetic displays in fountains or for giving the illusion of a geyser, whale spout, or the like. Typically, these displays and illusions have been created using a water-cannon device that employs compressed air to periodically blow water out of a tube or cylinder. As can be appreciated, the use of compressed air and a selected volume of water facilitates a controllable, intermittent discharge of water that may be desirable in water displays. However, the use of compressed air in water cannons generally results in a stream or spray of water that may quickly lose its shape or definition as the pressurized air freely mixes with the water in the tube and, more particularly, upon discharge from the water cannon.

SUMMARY OF THE INVENTION

The present inventors recognize that many users of water display devices may prefer a device that is capable of discharging discrete volumes of water maintaining a substantially well-defined shape (e.g., a liquid projectile) from the point of discharge to the point of impact with a second surface (e.g., target). It may also be preferable that the water display devices are controllable to discharge the liquid projectiles on demand (e.g., upon receiving an activation signal) or at established time intervals. In this manner, the user may employ a water display device as part of a water ride to fire liquid projectiles at a target in the vicinity of cars carrying ride participants as the cars pass a selected position along the water ride path. The well-defined shape of the liquid projectile allows the participants of the ride to see and be exposed to the water display in close proximity without being soaked by a stream or spray of water. Further, the water display users may desire that the liquid projectiles be dischargeable in various directions and at different trajectories depending on the ride or display effect desired. Continuing with the water ride example, it may be desirable that the discharge direction and trajectory of a series of liquid projectiles discharged by the water display device be altered in succession to fire the liquid projectiles at a target nearer and nearer to a car traveling along the water ride path. In this manner, it may also be desirable that the range (e.g., the horizontal distance traveled) of the liquid projectile be controllable and variable by the user of the water display device. Additionally, users may desire a water display device capable of producing liquid projectiles of varying size (e.g., varying volumes of water) and shape to create more dynamic and visually stimulating displays than with the use of sprays and streams of water alone. Although existing water display devices have fulfilled many needs of water display users, the present invention addresses various needs that remain to be satisfied.

The present invention is directed to a water display device and associated methods of operating the same. Generally, the water display device of the present invention includes a housing assembly, a liquid supply assembly, and a liquid discharge assembly. The housing assembly is configured to receive a discrete volume of a liquid (e.g., water) from the interconnected liquid supply assembly. The housing assembly further includes a liquid outlet for discharging the discrete volume of water from the housing assembly during operation of the water display device. The liquid discharge assembly provides an actuating force to discharge the discrete volume of water out of the liquid outlet at a discharge velocity thereby forming a liquid projectile. As can be appreciated, the size of the liquid projectile is dependent on the amount of water (e.g., the discrete volume) received by the housing assembly from the liquid supply assembly. Similarly, the shape of the liquid projectile is at least partially dependent on the configuration of the liquid outlet. Both the size and shape of the liquid projectile may readily be altered to satisfy the water display goals of the users of the water display device through control (e.g., solenoid valves) of the liquid supply assembly and by changing the configuration of the liquid outlet. In this regard, the liquid supply assembly may include one or more of piping or tubing, valves (e.g., manual valves, control valves, solenoid valves), pump(s), and a water source to provide water to the housing assembly. Alternatively, the liquid supply assembly may be simplified if the top of the water source is above the housing assembly to provide static head or if the water source delivers water under a satisfactory pressure.

According to one aspect of the present invention, the water display device employs mechanical components and interfaces to produce a liquid projectile. The use of a mechanical interface to force (e.g., push) the water from the housing assembly allows for improved definition of the produced liquid projectile by controlling the discharge force on the water and by reducing the mixture of air and water within the housing assembly. Generally, the water display device includes the housing assembly, the liquid supply assembly, and a mechanical discharge assembly. The housing assembly includes an inner chamber for receiving and storing a discrete volume of water from the interconnected liquid supply assembly. The inner chamber is preferably pressure resistant to withstand potentially high pressures (e.g., air, water) that are developed during operation of the water display device. The housing assembly further includes a liquid outlet preferably disposed at one end of the inner chamber. As can be appreciated, the liquid outlet may greatly affect the shape and even the number of produced liquid projectile(s) and in this regard, preferably includes a nozzle coupled (e.g., threaded, bolted, or other mechanical connection) to the inner chamber and configured to further define the shape of the liquid projectile(s).

To produce the liquid projectile, the mechanical discharge assembly is preferably at least partially disposed within the inner chamber of the housing assembly. To provide the discharge force and physical interface with the water, in one embodiment, the mechanical discharge assembly includes a first piston and piston shaft disposed within an elongate inner chamber and a compressed air source connected to the elongate inner chamber. The elongate inner chamber is preferably a hollow cylinder to facilitate use of a standard circular cross-section piston and to allow for standard sealing (e.g., o-rings) between the first piston and the walls of the elongate inner chamber. In this regard, a piston actuator may be used that provides a piston and a pressure-resistant, elongate inner chamber (e.g., a hollow cylinder). As can be appreciated, piston actuators may be selected that use various methods to move or cycle the piston including pneumatic and hydraulic systems. In a pneumatic piston actuator, for example, a compressed air source may be connected to the elongate inner chamber (e.g., cylinder of the actuator) at a point below the first piston and the liquid supply assembly may be connected to the inner chamber above the lower most point of the first piston's travel (e.g., above the first piston's position at the bottom of the first piston's stroke).

During operation of this embodiment, a discrete volume of water is received by the elongate inner chamber with the water at least partially staying in direct contact with the first piston. The compressed air is delivered into the elongate inner chamber below the first piston by the compressed air source at pressures high enough to quickly move the first piston and the discrete volume of water along a longitudinal axis of the elongate inner chamber. The water is forced out of the liquid outlet including the nozzle thereby forming a liquid projectile. Because the compressed air interfaces with the first piston and not the water, the liquid projectile maintains a substantially well-defined shape at the liquid outlet. As can be appreciated, the delivery of the compressed air to the elongate inner chamber can be controlled manually, semiautomatically, or automatically through the use of ball, control, solenoid, and other valves in communication with control devices (e.g., computer systems). For example, a three-way solenoid valve may be employed to operate the first piston cyclically at desired time intervals or sporadically upon receiving an activation signal.

As can be appreciated, cyclic operation may be improved by prompt and efficient repositioning or resetting of the first piston and piston shaft to pre-discharge positions (e.g., liquid fill positions) after each discharge. This may be accomplished by various devices including springs or other resilient devices, hydraulic systems, and/or pneumatic systems. In this regard, the present embodiment includes a second, elongate chamber (e.g., a hollow cylinder) in the housing assembly. The second, elongate chamber at least partially houses the piston shaft and an interconnected second piston of the mechanical discharge assembly. A compressed air source may be connected to the second, elongate chamber at a point above the second piston. During operation, the liquid projectile may be discharged as discussed above by movement of the first piston and piston shaft from a pre-discharge position to a discharge position. To reset the first piston and piston shaft in preparation of discharging another liquid projectile, compressed air is delivered to the second elongate chamber to contact the upper portion of the second piston and return the piston shaft and interconnected first piston to pre-discharge positions. The delivery of the compressed air can be controlled manually, semiautomatically, or automatically through the use of ball, control, solenoid, and other valves in communication with control devices (e.g., computer systems). For example, a three-way solenoid valve may be employed to operate the second piston to reset the piston shaft and first piston upon receiving an activation signal.

In another embodiment, the discharge force for producing a liquid projectile is provided by connecting a motive force (e.g., pneumatic or hydraulic) to the second piston disposed in the second elongate chamber of the housing assembly. In this embodiment, a compressed air source may be connected to the second, elongate chamber below the second piston. As may be appreciated, the second piston may again be employed to reset the first piston and piston shaft to pre-discharge positions by connecting a compressed air source at a point above the second piston. The delivery of the compressed air to contact the lower portion of the second piston can be controlled manually, semiautomatically, or automatically through the use of ball, control, solenoid, and other valves in communication with control devices (e.g., computer systems). For example, a three-way solenoid valve may be employed to operate the second piston at desired time intervals or sporadically upon receiving an activation signal. The use of three-way valves facilitates the displacement and discharge of air trapped within the second, elongate chamber above and below the second piston during discharge and resetting operations, respectively, thereby improving cyclic movement of the second piston and piston shaft.

According to another aspect of the present invention, the water display device may be used to produce liquid projectiles having various angles of trajectory. This may be accomplished, for example, by changing the position of the inner liquid chamber and correspondingly, the interconnected liquid outlet or by changing the position of the liquid outlet, or some portion thereof, independent of the inner liquid chamber. With such a water display device, a user may employ a single water display device to display or fire liquid projectiles at different positions and angles of trajectory relative to the horizon, including straight up (e.g., 90°) and angles of trajectory between straight up and the horizon (e.g., 0° to 90° and 90° to 180°). The water display device includes a housing assembly having an elongate inner chamber for receiving a discrete volume of water and an interconnected liquid outlet for facilitating discharge of the water from the housing assembly during operation.

As can be appreciated, the angle of trajectory of a liquid projectile is generally dependent upon the positioning of the elongate inner chamber and/or the configuration and positioning of the liquid outlet. In this regard, the water display device further includes a discharge positioning assembly that includes a base member and liquid outlet positioning member(s). The liquid outlet positioning member(s) may be used to mount the housing member to the base member for structural support during operation. As can be appreciated, the base member may be constructed of various materials (e.g., plastic, wood, metal) and in various shapes that provide adequate stability. For example, the base member may be fabricated in a substantially rectangular shape from steel channels. To further provide operating stability, the base member may be coupled to another structural surface.

Similarly, the liquid outlet positioning member(s) may be fabricated from various materials, such as steel channels, depending on the service environment (e.g., salt versus fresh water) of the water display device. The shape and number of positioning members employed may also vary depending on the size, weight, shape, and connecting interfaces of the housing assembly. For example, if the housing assembly is generally cylindrical, one rear and one forward positioning member may be used to position the inner chamber and liquid outlet. The rear positioning member may be pivotally mounted (e.g., through the use of a pin, a bracket on the housing assembly, and a mating, repositionable bracket on the rear positioning member) to the housing assembly at a location distal to the liquid outlet. Similarly, the forward positioning member may be pivotally mounted (e.g., through the use of a pin on the outer surface of the housing assembly and a repositionable bracket on the forward positioning member) to the housing assembly at a location proximate to the liquid outlet. With the use of pivotal mounting, the position of the elongate inner chamber and the interconnected liquid outlet may be changed by repositioning either, or both, the rear or the forward positioning member relative to the base member or by repositioning the repositionable brackets on either, or both, the rear or the forward positioning member. As can be appreciated, these repositioning steps may be completed manually, semiautomatically, or automatically (e.g., with computer-linked motors, gears, and tracks).

The angle of trajectory of a liquid projectile may be generally defined as the angle between a discharge axis of the projectile, e.g., the central longitudinal axis of the elongate inner chamber, and a plane substantially containing the base member or an axis in this plane. The discharge axis may not coincide with the central longitudinal axis when the liquid outlet includes a nozzle that directs the liquid projectile along an angle(s) relative to the central longitudinal axis of the elongate inner chamber. As can be appreciated, the trajectory of the liquid projectile is affected by the trajectory angle and other factors including the discharge velocity (e.g., velocity of the water at the liquid outlet).

In this regard, the effectiveness and versatility of the water display device is substantially improved by the ability to accurately establish and readily change the trajectory angle of the liquid projectiles. For example, according to the present invention, a user may initially locate the rear and forward positioning members, noted above, adjacent to each other on the base member. In this position, the elongate inner chamber would be positioned produce liquid projectiles with a 90° angle of trajectory. If the plane containing the base member substantially coincides with the horizon, the liquid projectile would travel straight up upon discharge. As the display requirements change, the user may reposition the rear and forward positioning members and corresponding repositionable brackets to achieve an angle of trajectory ranging from about 0° to 180° relative to the plane containing the base. As can be appreciated, air (e.g., trapped air) may enter the liquid outlet when the elongate chamber is positioned to produce certain angles of trajectory (e.g., less than about 30° and greater than about 150°). Because the discharge of the trapped air concurrently with the liquid projectile may detrimentally affect the definition of the liquid projectile, various methods, such as curved nozzles, may be employed to better facilitate the discharge of the trapped air prior to the discharge of the liquid projectile. In the above manner, the present invention provides the user substantial latitude and accuracy in establishing the angle of trajectory of the liquid projectiles produced by the water display device.

According to a further aspect of the present invention, the water display device is capable of varying the direction liquid projectiles are discharged relative to a reference axis. In this context, direction can be defined by the angle between a selected reference axis located in a plane containing the base member and the vector or positional component of the trajectory of the liquid projectile in this same plane. Such a water display device improves a water display by allowing a user to fire liquid projectiles that follow or track a moving object (e.g., a car on a water ride at an amusement park) or that creates a circular pattern which may be desirable in fountain displays. The water display device includes a housing assembly including a liquid outlet for discharging a discrete volume of water at a fixed or variable angle of trajectory (discussed in detail above) and in a variable direction and further, includes a base member which provides structural stability to the water display device. In this regard, the housing assembly is interconnected to the base member which may include a rotation element (e.g., a turntable or the like) that facilitates rotation of the base member and the interconnected housing assembly. The direction a liquid projectile is fired may range from 0° to about 360° relative to the reference axis depending on the needs of the user of the water display device. As can be appreciated, operation of the rotation element may be manual or motorized and can be controlled (e.g., geared) to provide accurate positioning of the housing assembly to establish the direction of the liquid projectiles produced by the water display device.

According to a still further aspect of the present invention, the water display device may be operated to produce liquid projectiles of varying size (e.g., volume of water) and with varying ranges. The water display device includes a housing assembly with an elongate inner chamber for receiving discrete volumes of water, a liquid supply assembly, and a liquid discharge assembly. The liquid supply assembly is interconnected to the elongate inner chamber to provide the water that makes up the liquid projectile. As can be appreciated, the liquid supply assembly may be controlled through various means, including the use of solenoid valves and level indicating devices connected to the elongate inner chamber, to supply varying amounts of water. In this manner, the size of the liquid projectile may be precisely controlled.

The size of the liquid projectile may also affect the range (e.g., horizontal or vertical distance traveled by a liquid projectile) of the water display device. In this regard, the liquid discharge assembly is coupled to the elongate inner chamber and provides a discharge force that imparts a discharge velocity (e.g., the velocity of the discrete volume of water at the liquid outlet) to the liquid projectile. If the discharge force is kept constant while reducing the size of the liquid projectile, the liquid projectile will have an increased discharge velocity and range. As will be appreciated, to maintain a given range while reducing the size of a liquid projectile, the discharge force may be reduced. For example, if the liquid discharge assembly includes a piston disposed within the elongate inner chamber that is coupled to a compressed air source, the range may be maintained by reducing the pressure of the air that is supplied to the piston. Alternatively, the distance the piston travels (e.g., stroke length) may be shortened to reduce the size of a particular liquid projectile and correspondingly, increase the range of that liquid projectile compared to a larger projectile at a given discharge velocity (e.g., at a constant air pressure). For example, a piston actuator having variable stroke lengths may be employed as part of the water display device.

DETAILED DESCRIPTION

The present invention is directed to a liquid projectile apparatus and related method of producing liquid projectiles. In the following description, several alternative embodiments of the invention are described in detail. It will be appreciated that many other alternatives, modifications, and configurations are possible in accordance with the present invention.

Figure 1:
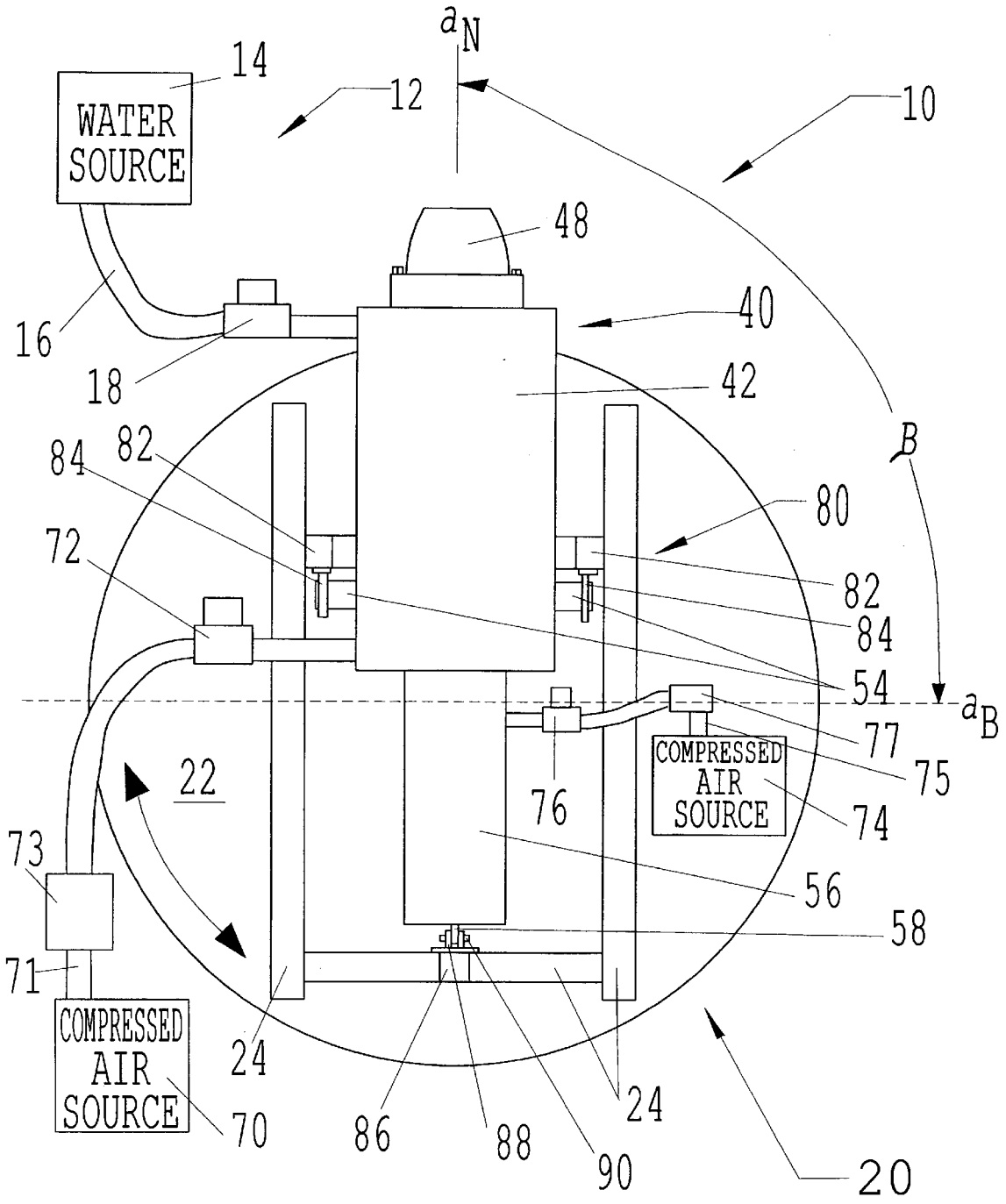
FIG. 1 is a top view of an embodiment of a liquid projectile apparatus of the present invention.
Figure 2:
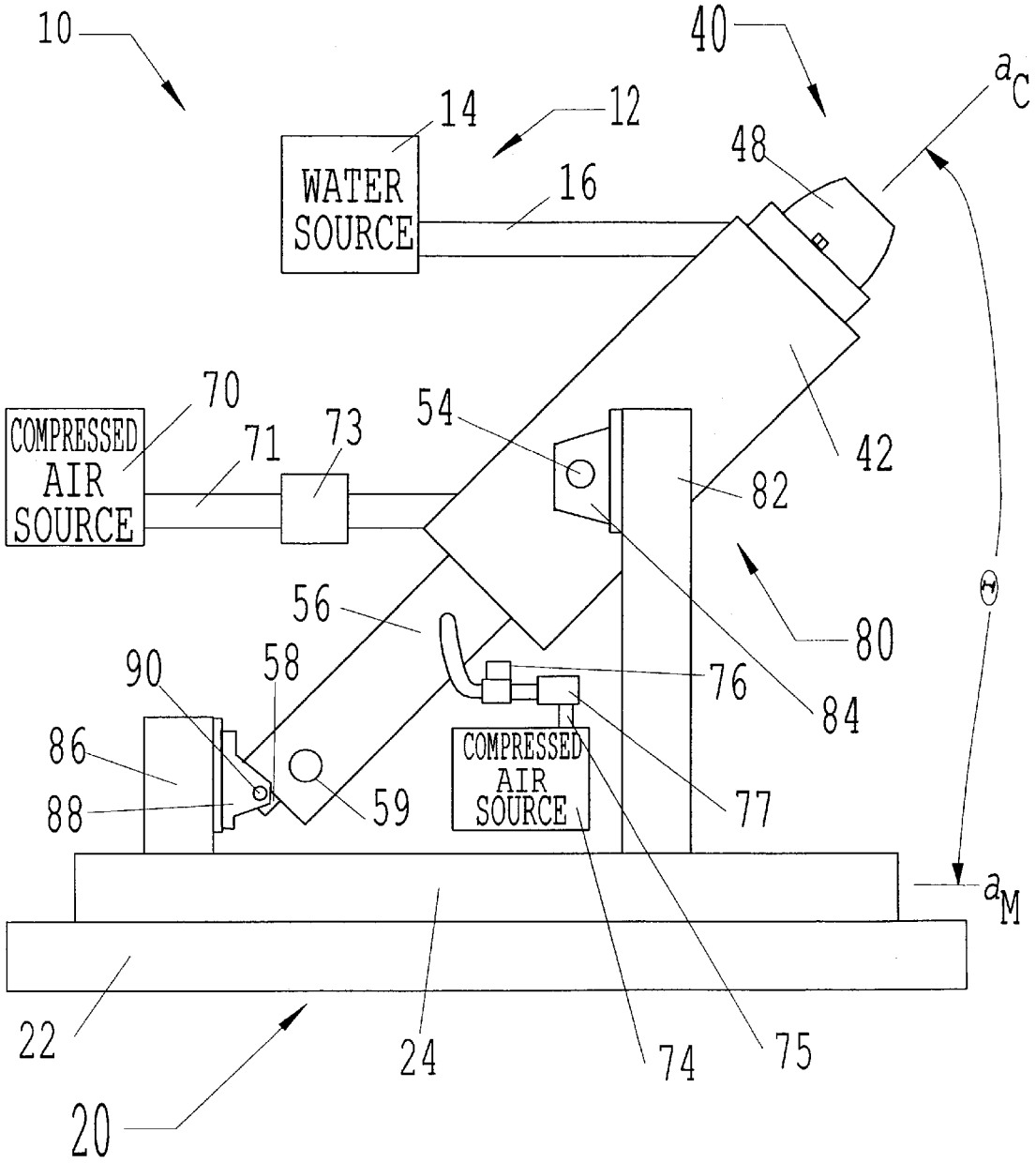
FIG. 2 is a side view of the liquid projectile apparatus of FIG. 1.
Figure 3:
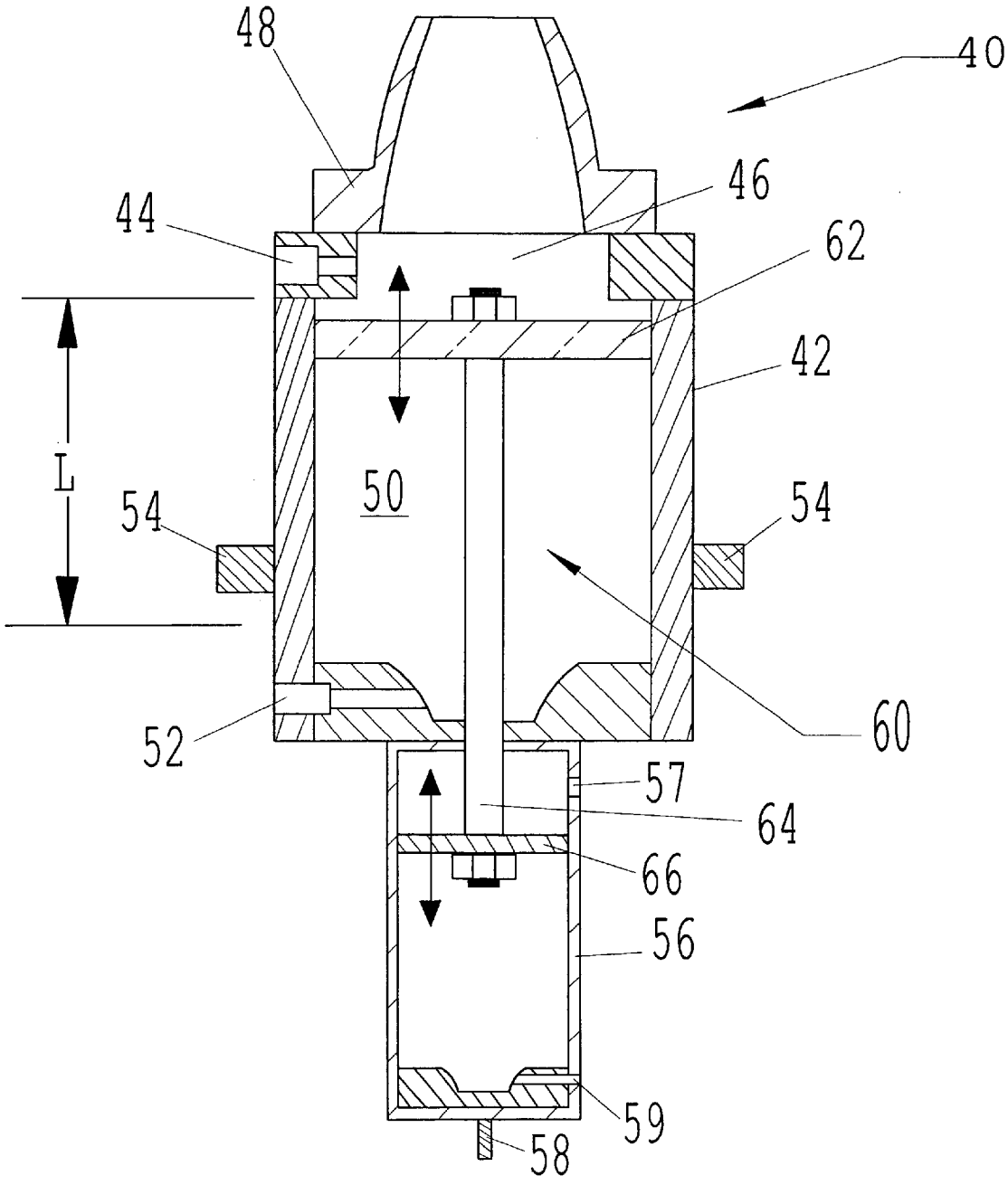
FIG. 3 is a partial cross-sectional view illustrating selected internal components of the liquid projectile apparatus of FIG. 1.

Referring to FIGS. 1 to 3, a liquid projectile apparatus 10 of the present invention is illustrated. Generally, the liquid projectile apparatus 10 includes a liquid supply assembly 12, a base assembly 20, a housing assembly 40, a mechanical discharge assembly 60, and a discharge positioning assembly 80. The components of the liquid projectile apparatus 10 act in combination to produce liquid projectiles (not shown) consisting of a discrete volume of liquid (e.g., water). The liquid projectile apparatus 10 may be used to produce liquid projectiles with varying shape and size, at various trajectories, in differing directions, and with an adjustable range. As can be appreciated, liquid projectiles may be desirable for use in fountains, amusement park rides, water shows, and the like.

In this regard, the liquid supply assembly 12 is in fluidic communication with the housing assembly 40 to provide the discrete volume of water used to produce each liquid projectile. The housing assembly 40 is mounted on the base assembly 20 for structural support and variable positioning (discussed in detail below). The housing assembly 40, at least partially, houses the mechanical discharge assembly 60 which is operable to force the discrete volume of water out of the housing assembly 40 in the form of a liquid projectile. Each liquid projectile is expelled from the housing assembly 40 in a direction (e.g., target direction) and at an angle (e.g., angle of trajectory) which are selectively adjustable through operation of the discharge positioning assembly 80 and the interconnected base assembly 20 on which the housing assembly 40 is mounted. The individual components and operation of the liquid projectile apparatus 10 will become apparent from the following description.

Referring to FIGS. 1 and 2, the liquid projectile apparatus 10 includes the liquid supply assembly 12. The liquid supply assembly 12 is used to provide a discrete volume of water that is used during operation of the liquid projectile apparatus 10 to produce a liquid projectile. As can be appreciated, it may be desirable to closely control the volume of water supplied to the housing assembly 40 by the liquid supply assembly 12 to vary the size of the liquid projectiles produced and to supply differing liquid volumes to alternative housing assemblies of with various liquid capacities. In this regard, the liquid supply assembly 12 includes water source 14, supply tubing 16, and water control valve 18. The supply tubing 16 fluidically couples the water source 14 to the housing assembly 40. The water source 14 may be any reliable source of water, for example, a reservoir, a fountain basin, a water tank, or a piped water source. The supply tubing 16 may be fabricated of rigid tubing materials (e.g., metals, plastics) but preferably is, at least partially, fabricated from flexible tubing materials to better facilitate the variable positioning of the housing assembly 40 and/or the water source 14. The water control valve 18 is disposed in the supply tubing 16 to control the flow of water from the water source 14 to the housing assembly 40. While manual valves (e.g., ball valves and the like) may be employed, the water control valve 18 preferably is a solenoid valve or other remotely controllable valve to provide improved control of water flow during operation of the liquid projectile apparatus 10. In this regard, control of the water control valve 18 may be accomplished with a central computer facility (not shown) in communication with water control valve 18, with a level indicating device (not shown) connected to the housing assembly 40 and to the water control valve 18, or with other control methods.

The base assembly 20 provides structural stability to the housing assembly 40 and may be rigidly or resiliently (e.g., to absorb operational vibration) connected to a separate support structure (e.g., a concrete pad, scaffolding for aerial mounting, or a vertical structure such as a wall) to provide further support and desired positioning of the liquid projectile apparatus 10 relative to a target or display area. Since it may be desirable to change the position of the housing assembly 40 relative to this separate support structure (not shown), the base assembly 20 facilitates repositioning (e.g., rotating) of the housing assembly 40 during operation of the liquid projectile apparatus 10. The base assembly 20 generally includes a rotatable base 22 and mounting members 24. The rotatable base 22 may be mounted (e.g., concrete anchors) to the separate support structure and may be, at least partially, fabricated from a motorized or manual turntable device. The mounting members 24 are coupled (e.g., screws and lock washers) to the rotatable base 22. To improve selective mechanical connection with the discharge positioning assembly 80 (discussed in detail below), the mounting members 24 may be fabricated from, for example, pierced metallic channel to provide adequate strength as well as numerous, equally spaced holes for making mechanical connections (e.g., screws and channel nuts).

Referring to FIGS. 1 to 3, the liquid projectile apparatus 10 further includes a housing assembly 40 for receiving a discrete volume of water from the liquid supply assembly 12, for housing the mechanical discharge assembly 60, and for shaping the discrete volume of water into liquid projectiles. The illustrated housing assembly 40 includes an upper piston housing 42 with an inner chamber 50 for housing the mechanical discharge assembly 60 and for receiving the discrete volume of water from the liquid supply assembly 12. In this regard, the upper piston housing 42 may consist of a hollow, metallic cylinder configured to receive a standard circular piston and to withstand the operational pressures developed within upper piston housing 42. The upper piston housing 42 includes a liquid inlet 44 for interconnecting the supply tubing 16 of the liquid supply assembly 12 with the inner chamber 50. To facilitate operation of the mechanical discharge assembly 60 (discussed in detail below), the upper piston housing 42 further includes a port 52 for coupling the inner chamber 50 and a first compressed air source 70 of the mechanical discharge assembly 60.

Additionally, the housing assembly 40 includes a lower piston housing 56 sealably interconnected to the upper piston housing 42 to safely accommodate the movement of a piston shaft 64 and to guide the movement of an upper piston 62 of the mechanical discharge assembly 60 within the housing assembly 40. The lower piston housing 56 may consist of a hollow, metallic cylinder configured to receive a standard circular piston and to withstand the operational pressures developed within lower piston housing 56. The lower piston housing 56 includes an upper port 57 and a lower port 59 to facilitate delivery and discharge of air into the lower piston housing 56 during operation of the liquid projectile apparatus 10 (discussed in detail below).

The upper piston housing 42 further includes a liquid outlet 46 for discharging the received volume of water. As illustrated in FIG. 3, the liquid outlet 46 may be in fluidic communication with a nozzle 48 included in the housing assembly 40 for shaping the discrete volume of water, as it is discharged from the inner chamber 50, into a liquid projectile. The nozzle 48 may be mechanically coupled (e.g., screws, threaded holes, and gasket material) to the upper piston housing 42. The internal configuration of the nozzle 48 may be selected to produce liquid projectiles having a wide range of shapes to support various uses of the liquid projectile apparatus 10. As illustrated, the nozzle 48 will tend to force the water to converge to form a liquid projectile having a generally cylindrical or bullet-like shape as the liquid projectile exits the nozzle 48. This shape for liquid projectiles has been found to better maintain its definition over a longer range (e.g., distance a liquid projectile travels) than less convergent shapes. As can be appreciated, a nozzle 48 may be selected to simultaneously produce more than one liquid projectile by including more than one outlet or to produce a variety of liquid projectile shapes and to direct the liquid projectile onto various flight paths (e.g., trajectories).

The housing assembly 40 further includes pivoting pins 54 and an exterior positioning bracket 58 for mechanically connecting the housing assembly 40 with the discharge positioning assembly 80 of the liquid projectile apparatus 10. These components are included because during operation liquid projectiles may be fired or discharged from the liquid projectile apparatus 10 at an angle of trajectory, Θ, that may be selected and changed by the user of the liquid projectile apparatus 10. As illustrated in FIG. 2, the angle of trajectory, Θ, is measured between a reference axis, $\alpha_M$, of the mounting member 24 and a central axis, $\alpha_C$, that coincides with the central axes of the inner chamber 50 of the housing assembly 40 and of the nozzle 48. In this regard, to enhance the ability of a user to select the angle of trajectory, Θ, two pivoting pins 54 are rigidly mounted on the sides of the upper piston housing 42 for mating with two upper piston housing support brackets 84 of the discharge positioning assembly 80. The pivoting pins 54 have a generally circular cross-section to enhance pivotal movement within the upper piston housing support brackets 84. The exterior positioning bracket 58 is rigidly attached to the lower piston housing 56 as illustrated in FIGS. 1 and 3. The exterior positioning bracket 58 mates with adjacently positionable lower piston housing support bracket 88 of the discharge positioning assembly 80 and includes a circular opening for receiving a rear pivoting pin 90 of the discharge positioning assembly 80. During operation, the housing assembly 40 is pivotable about the rear pivoting pin 90 to allow users to select an angle of trajectory, Θ (discussed in detail below).

The discharge positioning assembly 80 further includes two forward positioning members 82 and one rear positioning member 86 to interconnect with and support the upper piston housing support brackets 84 and the lower piston housing support bracket 88, respectively. The forward and rear positioning members 82 and 86, respectively, may be elongate, as illustrated, and fabricated from materials chosen to provide structural strength and to facilitate connection and disconnection with mounting members 24 of the base assembly 20. In this regard, the forward and rear positioning members 82 and 86, respectively, may be fabricated from pierced metallic channel having similar dimensions as the metallic channel used to fabricate the mounting members 24 to enhance ready connection and disconnection (e.g., with screws and channel nuts). As can be appreciated, the use of pierced channel improves the ease of positioning the forward and rear positioning members 82 and 86, respectively, at various points along the mounting members 24, thereby altering the angle of trajectory, Θ, at which liquid projectiles are fired from the liquid projectile apparatus 10.

To discharge water from the housing assembly 40 as liquid projectiles, the liquid projectile apparatus 10 includes a mechanical discharge assembly 60. The mechanical discharge assembly 60 provides the motive force to push or expel liquid from the inner chamber 50 of the piston housing 42 through the nozzle 48 to create a liquid projectile. As illustrated in FIG. 3, the mechanical discharge assembly 60 includes a circular cross-section, upper piston 62 disposed within the inner chamber 50 of the upper piston housing 42. As can be appreciated, the upper piston 62 preferably is positionable within the inner chamber 50 between the liquid inlet 44 and port 52. The upper piston 62 provides contact with water to be pushed out of the inner chamber 50 and also, with the medium (e.g., compressed air) used to move (e.g., stroke) the upper piston 62 within the inner chamber 50. In this regard, the mechanical discharge device includes a piston shaft 64 to enhance alignment of the upper piston 62 during the stroke. As can be appreciated, the piston shaft 64 may also be employed to control the stroke length, L, and, thereby, control the volume of liquid received within the inner chamber 50 to control the size of produced liquid projectiles.

To stroke the upper piston 62, the mechanical discharge assembly 60 includes a first compressed air source 70 in fluidic communication with the inner chamber 50 via air supply tubing 71. As can be appreciated, the pressure and rate at which the compressed air is supplied to the inner chamber 50 and the bottom of the upper piston 62 directly affects the motive force provided by the mechanical discharge assembly 60 for discharging water from the inner chamber 50 of the upper piston housing 42. In this regard, the mechanical discharge assembly 60 further includes an air supply control valve 72 and a pressure regulator/filter device 73 that control the flow and pressure of compressed air from compressed air source 70 to inner chamber 50. Although various control valves may be employed for this purpose, an air supply control valve 72 that consists of or employs a solenoid valve may enhance reliable, remote control of the flow of pressurized air to inner chamber 50 and upper piston 62. Further, other methods may be employed to move the upper piston 62 within the inner chamber 50, such as interconnected hydraulic or combustion systems. Similarly, it can be appreciated that although a mechanical discharge assembly 60 is employed in the illustrated liquid projectile apparatus 10, pressurized air flow without the use of a piston or other mechanical interface may be used to provide the motive force to discharge the water from the housing assembly 40 depending on display goals (e.g., less defined liquid projectiles) of users of the liquid projectile apparatus 10.

As can be appreciated, cyclic operation of the liquid projectile apparatus 10 depends at least partially on effective and timely repositioning or resetting of the upper piston 62 to a pre-discharge position after discharge of each liquid projectile. In this regard, the mechanical discharge assembly 60 includes a lower piston 66 disposed within lower piston housing 56 and a second compressed air source 74. The second compressed air source 74 is coupled to the lower piston housing 56 at the upper port 57 to deliver compressed air at a point above lower piston 66. The mechanical discharge assembly 60 further includes an air supply control valve 76 and a pressure regulator/filter device 77 to control the timing of air delivery and the pressure of delivered air, respectively. Although various control valves may be employed for this purpose, an air supply control valve 76 that consists of or employs a solenoid valve may enhance reliable, remote control of the flow of pressurized air to lower piston housing 56 and lower piston 66.

Referring to FIGS. 1 to 3, a method of producing liquid projectiles by operating the illustrated liquid projectile apparatus 10 will now be discussed. Initially, an operating location is selected from which the liquid projectiles will be produced (e.g., fired). The base assembly 20 is mounted at the selected operating location which may be, for example, the center of a fountain, an aerial platform, or an angled or vertical structure. As can be readily appreciated, the base assembly 20 may also be mounted on a mobile structure (e.g., a movable car on a track) to facilitate firing the liquid projectiles from multiple operating locations. The housing assembly 40 is then positioned on, and mounted to, the base assembly 20 through use of the discharge positioning assembly 80. Specifically, the rear positioning member 86 and interconnected lower piston housing support bracket 88 are coupled to a mounting member 24. The exterior positioning bracket 58 is mated with lower piston housing support bracket 88 and rear pivoting pin 90 is disposed therein to permit pivoting of lower piston housing 56 and interconnected upper piston housing 42.

Next, the user of the liquid projectile apparatus 10 may select an angle of trajectory, Θ, at which the liquid projectiles may be fired from the housing assembly 40. The angle of trajectory, Θ, is established by positioning upper piston housing 42 and interconnected nozzle 48 relative to the mounting members 24 of the base assembly 20. In this regard, the angle of trajectory, Θ, is readily adjustable by repositioning forward positioning members 82 relative to mounting members 24 and upper piston housing support brackets 84 relative to forward positioning members 82. For example, as illustrated in FIG. 2, the angle of trajectory, Θ, has been set at approximately 45 degrees. To increase the angle of trajectory, Θ, the forward positioning members 82 may be repositioned on mounting members 24 at a point more proximate to the rear positioning member 86 while maintaining, or slightly lowering, the position of the upper piston housing support brackets 84 on the forward positioning members 82. To decrease the angle of trajectory, Θ, the forward positioning members 82 may be repositioned on mounting members 24 at a point more distal to the rear positioning member 86 while lowering the upper piston housing support brackets 84 on the forward positioning members 82. As can be appreciated, it is preferable that the water supply tubing 16 and air supply tubing 71 and 75 are fabricated from flexible material to facilitate the repositioning of upper and lower piston housings 42 and 56. In the above manner, users of the liquid projectile apparatus 10 may readily and accurately establish the angle of trajectory, Θ, at which liquid projectiles are fired during operation of the liquid projectile apparatus 10.

After establishing the angle of trajectory, Θ, the liquid projectile apparatus 10 may be selectively positioned to fire liquid projectiles in a desired target direction. Referring to FIG. 1, the target direction may be defined by a direction angle, β, measured from a fixed reference axis, $\alpha_B$, to a nozzle location axis, $\alpha_N$, with both axes being contained in a plane that generally passes through the rotating base 22 of the base assembly 20. Referring to the illustrated liquid projectile apparatus 10, the direction angle, β, is set at approximately 90 degrees. To change the target direction of the liquid projectile, the rotating base 22 may be rotated in either the clockwise or counterclockwise direction. For example, the rotating base 22 may be rotated clockwise to reposition the upper piston housing 42 and interconnected nozzle 48 to a point where the direction angle, β, would be, for example, 45 degrees. In this manner, the direction angle, β, may be selectively adjusted from about 0 to about 360 degrees. To improve free rotation of the housing assembly 40, the water supply tubing 16 and the air supply tubing 71 and 75 preferably are fabricated from flexible materials. As can be appreciated, rotating the rotating base 22 to establish the direction angle, β, may be completed manually or may be motorized and remotely controlled (e.g., from a central computer facility) and in either case, may be precisely geared to allow a user to accurately set the target direction of the liquid projectiles. In this way, the liquid projectile apparatus 10 may be employed to fire or discharge liquid projectiles at various targets located about the mounting location of the liquid projectile apparatus 10 including moving targets.

With the housing assembly 40 positioned, the liquid projectile apparatus 10 may be operated to fire a liquid projectile. A discrete volume of water is supplied to upper piston housing 42 from the water source 14 of the liquid supply assembly 12 by operating water control valve 18. The water control valve 18 may be a manual valve or to improve the control of water flow, the water control valve 18 may be a solenoid valve or be solenoid controlled. As can be appreciated, the water control valve 18 may be controlled remotely or may be controlled locally by a level indicating sensor device (not shown) coupled to the upper piston housing 42. The water supply tubing 16 is coupled to the upper piston housing 42 at the liquid inlet 44 which is positioned to provide water at a point above the upper piston 62 of the mechanical discharge device 60. The water is received into the inner chamber 50 of the upper piston housing 42. Because the volume of water that may be received by the inner chamber 50 (e.g., the volume of the inner chamber) limits the size of the liquid projectile, the liquid projectile apparatus 10 may be fabricated with a selected size of upper piston housing 42 to vary diameter (e.g., bore) and/or length (e.g., stroke length) and, therefore, volume of the inner chamber 50. Further, the volume of water supplied to the inner chamber 50 preferably is less than the full volumetric capacity of the inner chamber 50 to allow the upper piston 62 to develop a discharge velocity in the water that produces a liquid projectile with a desired shape and range.

Referring to FIG. 3, the inner chamber 50 houses the upper piston 62 and, at least partially, the piston shaft 64 of the mechanical discharge assembly 60. Water is supplied to the inner chamber 50 with the upper piston 62 positioned in a pre-discharge position. The length, L, (e.g., stroke) the upper piston 62 will travel within the inner chamber 50 may be limited by the configuration of the inner chamber 50, as illustrated, and/or by commonly known devices (e.g., springs, stop washers, and the like) (not shown) attached to the piston shaft 64 and housed in lower piston housing 56 and/or upper piston housing 42. As can be appreciated, the length, L, may be made variable to control the size and/or range of the liquid projectile produced by the liquid projectile apparatus 10.

After the water has been received in the inner chamber 50, pressurized air is delivered to the inner chamber 50 from the compressed air source 70 at a pressure controlled by air pressure regulator/filter device 73. The flow of the pressurized air is controlled by the air supply control valve 72 which may be a solenoid valve to permit control of the pressurized air flow from a remote location. The pressurized air travels from compressed air source 70 through air supply tubing 71 and air supply control valve 72 to compressed air inlet 52 which is contained in upper piston housing 42 below upper piston 62. As the pressurized air flows into the inner chamber 50, the upper piston 62 is quickly pushed along the inner chamber 50. As can be appreciated, the water is pushed by the upper piston 62 through the inner chamber 50, through the liquid outlet 46 of the upper piston housing 42, and out the nozzle 48. The upper piston 62 imparts a discharge velocity to the water that determines the range the liquid projectile will travel upon discharge from the nozzle 48. In this regard, the discharge velocity, and therefore, the range of the liquid projectile, may be controlled by controlling the pressure and flow rate of the pressurized air delivered by the compressed air source 70. The operating cycle described above may be repeated as desired to, for example, fire liquid projectiles at predetermined, timed intervals or upon receiving sporadic signals from interconnected control device(s) (not shown). Additionally, positioning of the housing assembly 40 to establish a target direction by selecting a direction angle, β, and an angle of trajectory, Θ, and control of the water control valve 18 and the air supply control valve 72 may be linked or coupled (e.g., through a central computer facility) to enhance synchronized movement and operation of the various components of liquid projectile apparatus 10.

As part of the operating cycle, the upper piston 62 may be reset (e.g., repositioned) within the inner chamber 50 to a pre-discharge position in preparation of discharging another liquid projectile. After discharge is complete, air supply control valve 76 may be operated (i.e., through a remote activation signal) to deliver air from the second compressed air source 74 at a pressure controlled by air pressure regulator/filter device 77. As air enters the lower piston housing 56, the lower piston 66 is displaced (i.e., pushed lower within the lower piston housing 56), thereby moving the interconnected piston shaft 64 and upper piston 62 to the pre-discharge position. As lower piston 66 is pushed lower within the lower piston housing 56, air is freely discharged through lower port 59 which is open to the atmosphere. Similarly, as upper piston 62 is moved (e.g., pulled via interconnected piston shaft 64) to the pre-discharge position within the inner chamber 50, air is discharged through air supply control valve 72 which may, in this regard, be a three-way solenoid valve. Air supply control valve 76 may be a three-way solenoid valve to facilitate the discharge of air displaced by the lower piston 66 during discharge operations. In this manner, the liquid projectile apparatus 10 may be repeatedly operated to fire a liquid projectile and then be promptly reset to accept more water in preparation of firing the next liquid projectile.

Figure 4:
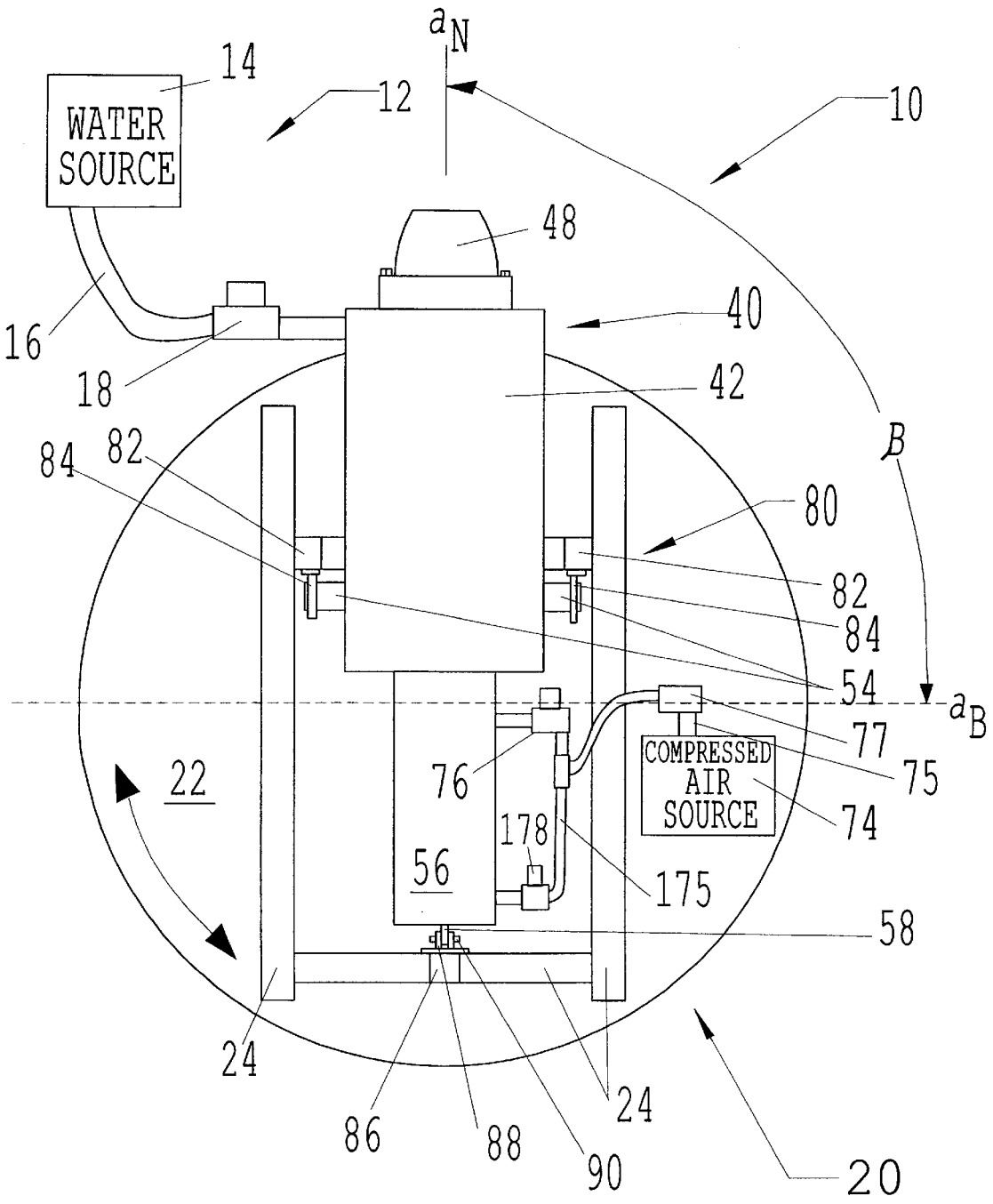
FIG. 4 is a top view of an alternative embodiment of a liquid projectile apparatus of the present invention.

In another inventive embodiment of the present invention, the lower piston 66 is employed to provide a discharge force to produce a liquid projectile and to provide the reset function discussed above. Referring to FIGS. 3 and 4, it can be seen that air supply tubing 175 is configured to deliver pressurized air from compressed air source 74 via air pressure regulator/filter device 77 to air supply control valves 76 and 178. Air supply tubing 175 is coupled to lower piston housing 56 at upper and lower ports 57 and 59 so as to provide pressurized above and below lower piston 66. Another feature of this embodiment is that port 52 of the upper piston housing 42 is open to the atmosphere to function as an inlet and outlet for ambient air during the discharge and reset operations, respectively.

During liquid projectile discharge operations, pressurized air is delivered to the lower piston housing 56 from the compressed air source 74 at a pressure controlled by air pressure regulator/filter device 77. The flow of the pressurized air is controlled by air supply control valve 178 which may be a solenoid valve to permit control of the pressurized air flow from a remote location. The pressurized air flows into the lower piston housing 56 through air supply tubing 175, air supply control valve 178, and port 59 at a point below lower piston 66. Lower piston 66 is quickly pushed upward within lower piston housing 56 to push piston shaft 64 and interconnected upper piston 62 upward to impart a discharge velocity on water contained within the inner chamber 50. Air trapped within the lower piston housing 56 above the lower piston 66 is discharge from the lower piston housing 56 through air supply control valve 76 which is preferably a three-way valve.

To reset the mechanical discharge assembly 60, pressurized air is delivered via compressed air source 74, air pressure regulator/filter device 77, air supply tubing 175, and air supply control valve 76 to port 57 of lower piston housing 56. Port 57 is located above lower piston 66 so that the flow of the pressurized air into lower piston housing 56 pushes lower piston 66 and interconnected piston shaft 64 and upper piston 62 to pre-discharge positions. During the resetting of upper and lower pistons 62 and 66, respectively, air trapped within the inner chamber 50 and within the lower piston housing 56 is discharged through port 52 and through air supply control valve 178 (e.g., a three-way valve). In this manner, the lower piston 66 may be operated to provide both the discharge and the resetting forces to cyclically operate the liquid projectile apparatus 10. To one skilled in the art, it may be apparent that a single four-way or other appropriate multi-port valve may be substituted for the two, three-way, air supply control valves 72 and 76.

As can be appreciated, the dimensions (e.g., piston diameter and cylinder length) of the upper and lower pistons 62 and 66 and inner chamber 50 and lower piston housing 56 may be selected to produce a desired discharge force at a given air pressure and air volume. As illustrated, the upper piston 62 and inner chamber 50 have larger dimensions than the lower piston 66 and lower piston housing 56. In operation, a desired discharge force may be developed by delivering pressurized air below either upper piston 62 or lower piston 66, as discussed above. As can be appreciated, when the lower piston 66 is employed as the discharge piston, air would be delivered to the lower piston housing 56 at a higher pressure but lower volume than would be delivered to the inner chamber 50 when the upper piston 62 is employed. In this regard, by varying the dimensions discharge pistons and cylinders, a liquid projectile apparatus 10 may be advantageously configured to operate efficiently with a range of compressed air sources (e.g., with differing pressure and volume capacities) to produce liquid projectiles having a desired size and range.

While various implementations of the present invention have been described in detail, it is apparent that further modifications and adaptations of the invention will occur to those skilled in the art. However, it is expressly understood that such modifications and adaptations are within the spirit and scope of the present invention.

What is claimed is:

1. An apparatus for use in producing a discrete liquid projectile formed from a volume of a liquid, said apparatus comprising:

housing means for receiving the volume of the liquid, said housing means including a liquid outlet for discharge of the volume of the liquid from said housing means into an air environment;

liquid supply means, fluidically interconnected to said housing means, for supplying the volume of the liquid to said housing means;

mechanical discharge means for mechanically discharging the volume of the liquid through said liquid outlet of said housing means so as to produce said liquid projectile; and trajectory selection means for changing a trajectory along which said liquid projectile travels upon said mechanical discharge from said liquid outlet by said mechanical discharge means, whereby a trajectory for projecting a particular liquid projectile can be selected;

said liquid outlet and said mechanical discharge means cooperating to discharge said liquid projectile into said air environment as a bounded, integrated slug of said liquid separate from said liquid outlet that substantially remains an integrated slug after discharge from said liquid outlet into said air environment.

2. An apparatus as recited in claim 1, wherein said liquid outlet of said housing means includes a nozzle for forming the mechanically discharged volume of the liquid so as to reduce dispersion of said liquid projectile.

3. An apparatus as recited in claim 1, wherein said housing means includes a first elongate inner chamber for receiving the volume of the liquid, said first elongate chamber being fluidically interconnected to said liquid outlet of said housing means.

4. An apparatus as recited in claim 3, wherein said mechanical discharge means includes a first piston disposed within said first elongate inner chamber of said housing means so as to contact the received volume of the liquid.

5. An apparatus as recited in claim 4, wherein said mechanical discharge means includes a compressed air source coupled with said first elongate inner chamber of said housing means to provide selective mechanical movement of said first piston within said first elongate inner chamber, said mechanical discharge means further including a pressure control means for controlling an air pressure at which air from said compressed air source is provided to said elongate inner chamber.

6. An apparatus as recited in claim 5, wherein said mechanical discharge means includes a second piston disposed within a second elongate inner chamber of said housing means, said second piston being interconnected to said first piston.

7. An apparatus as recited in claim 6, wherein said mechanical discharge means includes a compressed air source coupled with said second elongate inner chamber of said housing means to provide selective mechanical movement of said second piston and of said interconnected first piston within said second and first elongate inner chambers, respectively.

8. An apparatus as recited in claim 1, wherein said trajectory selection means comprises means for varying a discharge angle of said liquid projectile relative to a first reference axis contained in a first reference plane.

9. An apparatus as recited in claim 1, wherein said mechanical discharge means includes a range selection means for controlling a distance a particular liquid projectile travels relative to said liquid outlet of said housing means upon said mechanical discharge from said liquid outlet by said mechanical discharge means.

10. An apparatus as recited in claim 1, wherein said mechanical discharge means includes a size selection means for selecting a particular volume of the liquid to be supplied to said housing means by said liquid supply means, whereby a size of a particular liquid projectile may be selected.

11. An apparatus for use in producing a discrete liquid projectile formed from a volume of a liquid, said apparatus comprising:

housing means for receiving the volume of the liquid, said housing means including a liquid outlet for discharge of the volume from said housing means;

liquid supply means, fluidically interconnected to said housing means, for supplying the volume of the liquid to said housing means;

discharge means for discharging the volume of the liquid through said liquid outlet of said housing means into an air environment so as to project the volume along a trajectory thereby producing the liquid projectile, said discharge means being operative to discharge said liquid projectile into said air environment as a bounded integrated slug of said liquid separate from said liquid outlet that substantially remains an integrated slug after discharge from said liquid outlet into said air environment; and trajectory selection means for changing said trajectory, whereby a trajectory for projecting a particular liquid projectile can be selected.

12. An apparatus as recited in claim 11, wherein said trajectory selection means comprises means for varying a discharge angle of said liquid projectile relative to a first reference axis contained in a first reference plane.

13. An apparatus as recited in claim 12, wherein said discharge angle is variable relative to said first reference axis.

14. An apparatus as recited in claim 13, wherein said discharge angle is variable relative to said first reference plane.

15. An apparatus as recited in claim 14, wherein said means for varying said discharge angle includes a housing positioning means, coupled to said housing means, for moving said housing means including said liquid outlet between a first discharge angle position and a second discharge angle position.

16. An apparatus as recited in claim 11, wherein said trajectory selection means comprises a nozzle for forming the discharged volume of the liquid so as to reduce dispersion of said liquid projectile.

17. An apparatus as recited in claim 11, wherein said trajectory selection means comprises pivoting means for pivoting said housing means including said liquid outlet about a second reference axis contained in a second reference plane from a first discharge direction position to a second discharge direction position.

18. An apparatus as recited in claim 11, wherein said housing means includes an elongate inner chamber for receiving the volume of the liquid and said discharge means includes a piston for mechanically discharging the received volume of the liquid, said piston being disposed within said elongate inner chamber so as to contact the received volume of the liquid.

19. An apparatus as recited in claim 18, wherein said discharge means includes a compressed air source coupled with said elongate inner chamber of said housing means to provide selective mechanical movement of said piston within said elongate inner chamber, said mechanical discharge means further including a pressure control means for controlling an air pressure at which air from said compressed air source is provided to said elongate inner chamber.

20. An apparatus for use in producing a discrete liquid projectile formed from a volume of a liquid, said apparatus comprising:

housing means for receiving the volume of the liquid, said housing means including a liquid outlet for discharge of the volume of the liquid from said housing means into an air environment;

liquid supply means, fluidically interconnected to said housing means, for supplying the volume of the liquid to said housing means;

mechanical discharge means for mechanically discharging the volume of the liquid through said liquid outlet of said housing means so as to provide said liquid projectile, said mechanical discharge means including a piston disposable within said housing means; and discharge positioning means for changing a discharge position of said liquid outlet so as to alter a trajectory of said liquid projectile said liquid outlet and said mechanical discharge means said liquid outlet and said mechanical discharge means cooperating to discharge said liquid projectile into said air environment as a bounded, integrated slug of said liquid separate from said liquid outlet that substantially remains an integrated slug after discharge from said liquid outlet into said air environment.

21. An apparatus as recited in claim 20, wherein said mechanical discharge means includes a range selection means for controlling a distance a particular liquid projectile travels relative to said liquid outlet of said housing means upon said mechanical discharge from said liquid outlet by said mechanical means.

22. An apparatus as recited in claim 20, wherein said mechanical discharge means includes a size selection means for selecting a particular volume of the liquid to be supplied to said elongate chamber of said housing means by said liquid supply means, whereby a size of a particular liquid projectile may be selected.

23. An apparatus as recited in claim 20, wherein said housing means includes an elongate inner chamber for receiving the volume of the liquid, said elongate chamber being fluidically interconnected to said liquid outlet of said housing means, said piston of said mechanical discharge means being disposed within said elongate inner chamber of said housing means so as to contact the received volume of the liquid.

24. An apparatus as recited in claim 23, wherein said mechanical discharge means includes a compressed air source coupled with said elongate inner chamber of said housing means for moving said piston within said elongate inner chamber, said mechanical discharge means further including a pressure control means for controlling an air pressure at which air from said compressed air source is provided to said elongate inner chamber so as to control said trajectory of said liquid projectile.

25. An apparatus as recited in claim 20, wherein said discharge positioning means includes a base element connected to said housing means to provide structural stability to said housing means, said base element including a rotating means for rotating said housing means including said liquid outlet about a first reference axis contained in a first reference plane so as to as to select a trajectory of said liquid projectile.

26. An apparatus as recited in claim 25, wherein said discharge positioning means includes a housing positioning means for varying a discharge angle of said liquid projectile relative to a second reference axis contained in a second reference plane, said housing positioning means being coupled to said housing means for moving said housing means from a first discharge angle position to a second discharge angle position.

27. A method of producing a discrete liquid projectile formed from a volume of a liquid, comprising the steps of:

providing a housing for receiving the volume of the liquid, said housing including a liquid outlet for discharging the volume of the liquid into an air environment;

providing a mechanical discharge means for mechanically expelling the volume of the liquid out of said housing, said mechanical discharge means including a piston positionable within said housing to contact the volume of the liquid;

filling said housing with the volume of the liquid;

operating said mechanical discharge means to mechanically project the volume of the liquid out of said liquid outlet of said housing along a trajectory, thereby producing said liquid projectile, such that said liquid projectile is discharged into said air environment as a bounded, integrated slug of said liquid separate from said liquid outlet that substantially remains an integrated slug after discharge from said liquid outlet into said air environment;

providing a trajectory selection means for changing said trajectory, whereby a trajectory for projecting a particular liquid projectile can be selected; and operating said trajectory selection means to select said trajectory for projecting said particular liquid projectile.

28. A method as recited in claim 27, wherein said trajectory selection means comprises means for varying a discharge angle of said liquid projectile relative to a first reference axis contained in a first reference plane.

29. A method as recited in claim 27, wherein said trajectory selection means comprises rotating means for rotating said housing means including said liquid outlet about a second reference axis contained in a second reference plane from a first discharge direction position to a second discharge direction position.

* * * * *